US005583402A

United States Patent [19]

Moisin et al.

[11] Patent Number: 5,583,402

[45] Date of Patent: Dec. 10, 1996

[54] SYMMETRY CONTROL CIRCUIT AND METHOD

[75] Inventors: Mihail S. Moisin, Lake Forest, Ill.; Bryce L. Hesterman, Fort Wayne, Ind.; Antonio Marques, Hattiesburg, Miss.; Allan A. Nostwick, Huntington, Ind.

[73] Assignee: MagneTek, Inc., Nashville, Tenn.

[21] Appl. No.: 190,746

[22] Filed: Jan. 31, 1994

(Under 37 CFR 1.47)

[51] Int. Cl.[6] ..... G05F 1/00

[52] U.S. Cl. ..... 315/307; 315/308; 315/209; 315/226; 315/DIG. 7; 315/244

[58] Field of Search ..... 315/307, 308, 315/209 R, 219, 224, 226, 244, 239, 246, DIG. 4, DIG. 5, DIG. 7; 363/40, 41, 95, 97, 98, 133, 134, 24, 25, 26

[56] References Cited

U.S. PATENT DOCUMENTS

| | | | |
|---|---|---|---|
| 4,277,728 | 7/1981 | Stevens | 315/307 |
| 4,370,600 | 1/1983 | Zansky | 315/244 |
| 4,392,087 | 7/1983 | Zansky | 315/219 |
| 4,415,839 | 11/1983 | Lesea | 315/308 |
| 4,535,399 | 8/1985 | Szepesi | 315/307 X |
| 4,819,146 | 4/1989 | Nilssen | 363/98 |
| 4,952,849 | 8/1990 | Fellows et al. | 315/307 |
| 4,983,887 | 1/1991 | Nilssen | 315/224 |
| 5,103,139 | 4/1992 | Nilssen | 315/219 |
| 5,138,234 | 8/1992 | Moisin | 315/209 R |
| 5,159,541 | 10/1992 | Jain | 363/26 |
| 5,245,253 | 9/1993 | Quazi | 315/224 |
| 5,424,613 | 6/1995 | Moriarty, Jr. | 315/209 R |

FOREIGN PATENT DOCUMENTS

| | | | |
|---|---|---|---|
| 3338464 | 5/1985 | Germany | 363/37 |

OTHER PUBLICATIONS

Jain et al., "Asymmetrical Pulse Width Modulated Resonant DC/DC Converter Topologies," PESC'93 Record, 1993, pp. 818–825.

Wood, "Next Generation Electronic Ballasts Using the New Cost Saving IR2155 MGD," Application Note No. AN–995, 1993, pp. 1–15.

*Primary Examiner*—Robert Pascal
*Assistant Examiner*—Haissa Philogene
*Attorney, Agent, or Firm*—Seldon & Scillieri

[57] ABSTRACT

The present invention provides a method and circuit for controlling the flow of current through a load. In a preferred embodiment, an oscillator generates a pulse signal of constant frequency. A pulse width modulator adjusts the duty cycle of the pulse signal in response to a dimming level signal input indicative of the desired level of current flow through the load. A converter receives the pulse signal as an input and converts it into an AC signal, the frequency of which follows the frequency of the pulse signal and the symmetry of which varies with the duty cycle of the pulse signal. The load is connected into a resonant circuit tuned such that a change in the symmetry of the AC signal changes the level of current flowing through the load.

9 Claims, 8 Drawing Sheets

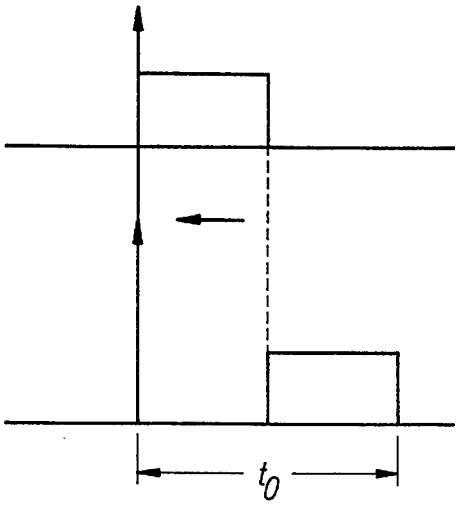
FIG. 2A
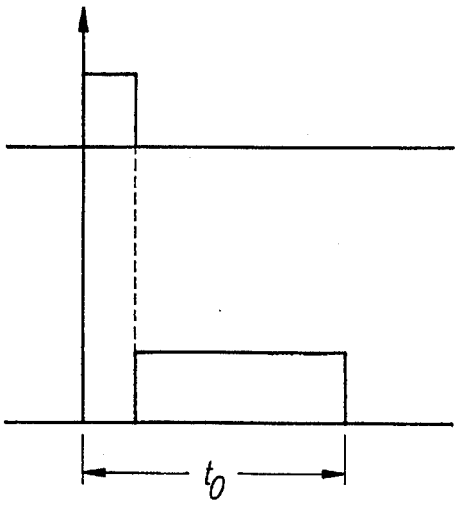
FIG. 2B
FIG. 2C
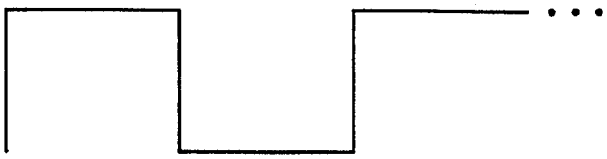
FIG. 2D
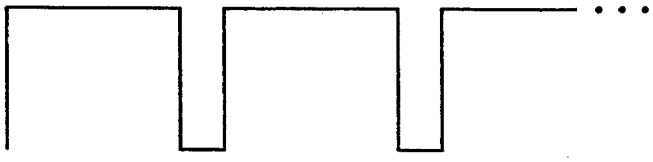
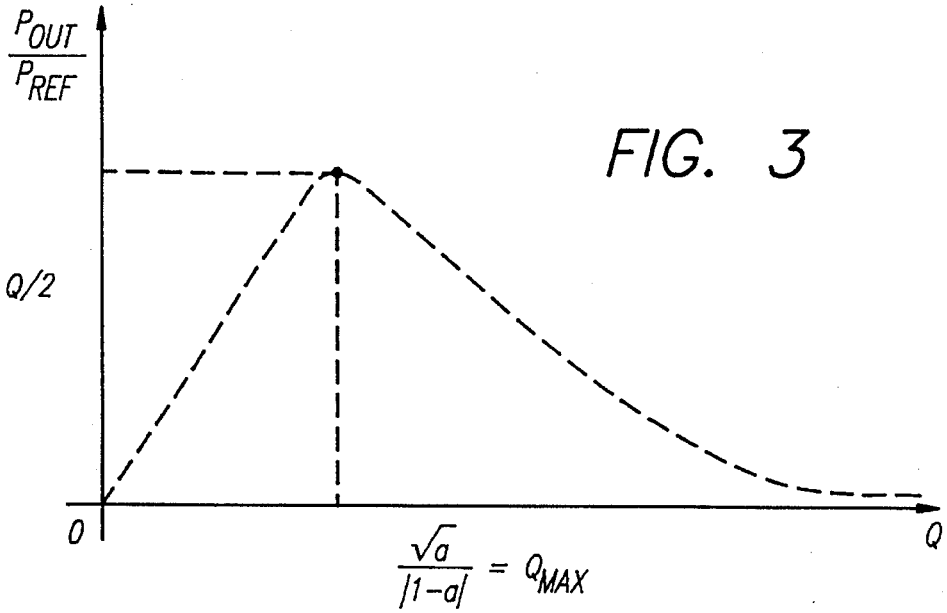
FIG. 3

AC SUPPLY
EMI FILTER
BRIDGE RECTIFIER
CONTROLLER SUPPLY
POWER FACTOR CORRECTION
DELAYED START
IN
OUT
COMMON
FILAMENT AND DC VOLTAGE SOURCE
AC
LAMP
LAMP
COMMON AC RECTIFIER AND FILTER
COMPENSATION NETWORK
ISOLATION INTERFACE
DIMMING SIGN
ERROR AMP
RESET LENGTH TIMER
PHASE LAG IN COMMON
CONTROL
CONTROL
CONTROL
10
20
30
31
60
61
62
63
70
80
90
100
101
102
103
111
112
113
114
115
116
117
118
119
120
121
122
130
140
150
160
170
180
181
190
195
200
240

SYMMETRY CONTROL CIRCUIT AND METHOD

BACKGROUND OF THE INVENTION

1. Technical Field

The present invention relates generally to control circuits and in particular to ballast circuits used to drive gas discharge lamps, such as fluorescent lamps.

2. Background Art

In one prior art approach, a gas discharge lamp is connected into a resonant circuit. Control of the current flowing through the lamp is accomplished by varying the frequency of the AC signal driving the circuit. Maximum current is delivered to the lamp where the frequency of the pulse signal equals the resonant frequency of the circuit. As the frequency of the pulse signal diverges away from the resonant frequency, there is an attendant dropoff of current flowing through the lamp.

The chief advantage of this approach is its relative simplicity. However, this approach suffers from known disadvantages. Gas discharge lamps exhibit a nonlinear behavior, in which the voltage across the lamp increases as the lamp current decreases. This affects the range of frequency variation required for a given desired range of dimming. Further, the frequency of the pulse signal used to drive the circuit cannot fall below a critical threshold frequency, i.e., the loaded resonant frequency. Below this threshold, the circuit begins to oscillate in a "capacitive" mode, leading to destruction of circuit components. In addition, the overall efficiency of the circuit may be compromised, as circuit components do not exhibit optimal performance throughout the range of frequencies that may be needed for control.

SUMMARY OF THE INVENTION

The present invention provides a method and circuit for controlling the flow of current through a load. In a preferred embodiment, an oscillator generates a pulse signal of constant frequency. A pulse width modulator adjusts the duty cycle of the pulse signal in response to a dimming level signal input indicative of the desired level of current flow through the load. An inverter receives the pulse signal as an input and converts a DC signal into an AC signal, the frequency of which follows the frequency of the pulse signal and the symmetry of which varies with the duty cycle of the pulse signal. The load is connected into a resonant circuit tuned such that a change in the symmetry of the AC signal changes the level of current flowing through the load.

In an alternative preferred embodiment, the symmetry is controlled by varying the pulse width of one level of the pulse signal, but not the other. This has the additional effect of varying the frequency of the pulse signal. Because a low-Q resonant circuit is preferably used with this type of drive, the change in frequency affects the load current to a lesser degree than the change in symmetry.

BRIEF DESCRIPTION OF THE DRAWINGS

FIG. 2A is a graph showing the symmetrical output of the pulse width modulator shown in FIG. 1, operating at a duty cycle of 50 percent.

FIG. 2B is a graph showing the asymmetrical output of the pulse width modulator shown in FIG. 1, operating at a duty cycle of less than 50 percent.

FIGS. 2C and 2D show a pulse signal generated in an alternative preferred embodiment of the present invention at full output (FIG. 2C) and at dimmed output (FIG. 2D).

FIG. 3 is a graph showing the optimal design point for a resonant circuit in accordance with the present invention.

FIG. 6A shows a symmetry control circuit, FIG. 6B shows a series resonant converter, FIG. 6C shows a dimming interface circuit, and FIG. 6D shows a boost PFC circuit.

DESCRIPTION OF SPECIFIC EMBODIMENTS

Figure 1:
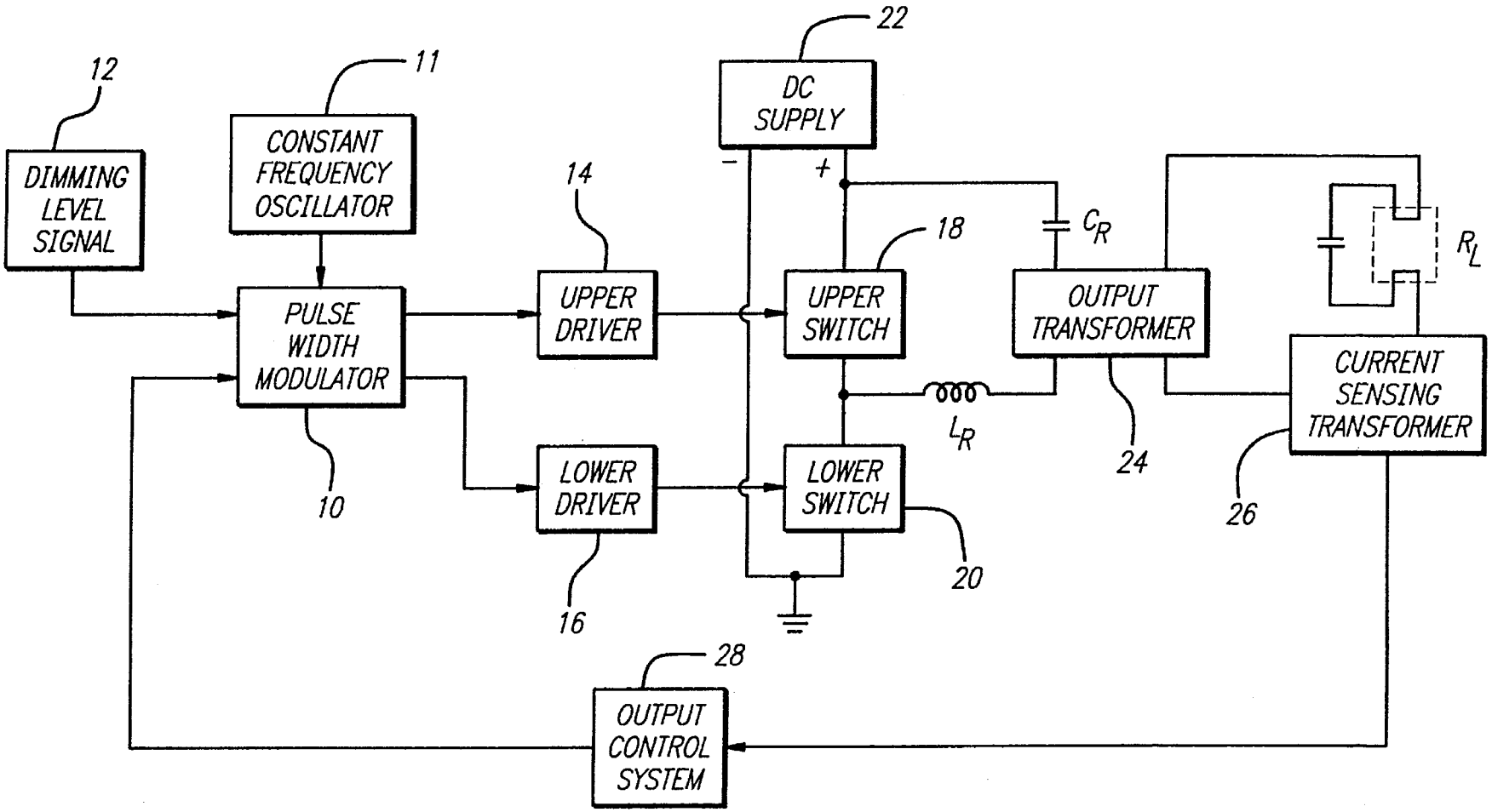
FIG. 1 is a block diagram of a preferred embodiment of a circuit according to the present invention.

FIG. 1 shows a block diagram of a control circuit according to the present invention. The control loop functions by using a pulse width modulator 10 to vary the duty cycle of the pulse signal output of a constant frequency oscillator 11 in response to a dimming level signal 12 indicating a desired level of current flow through the load. The modulated signal is then fed to a pair of drivers 14, 16, that drive an associated pair of switches 18, 20 on a high-voltage DC supply 22 in a half-bridge inverter configuration. The AC signal thus generated drives the resonant circuit made up of inductor $L_R$, capacitor $C_R$ and the lamp load $R_L$, the resistance of which is reflected into the resonant circuit via output transformer 24. As discussed below, the resonant RLC circuit is preferably tuned to a frequency slightly lower than the frequency of the pulse signal generated by the constant frequency oscillator 11.

In the series resonant converter shown in FIG. 1, the output transformer 24 is connected in series with resonant inductor $L_R$ and resonant capacitor $C_R$. It is possible to practice the present invention with a circuit in which the output transformer is connected directly to the upper and lower switches, with the resonant inductor and capacitor connected into the load side of the transformer. However, the arrangement shown in FIG. 1 has the advantage of the input to the transformer being sinusoidal, rather than a square wave, which would couple more noise through the interwinding capacitance. Further, placing the output transformer directly after the upper and lower switches would have the added disadvantage that the transformer would have to carry the volt-amperes associated with the entire resonant circuit and load as opposed to just carrying the volt-amperes of the load.

The control loop is completed by current sensing transformer 26 and output control system 28, which generate a current level signal that is fed back to the pulse width modulator 10. The pulse width modulator compares the current level signal with the dimming level signal 12, and the result of the comparison is used to adjust the duty cycle of the pulse signal such that the load current is maintained at a constant level.

The circuit shown in FIG. 1 controls the amount of current flowing through the load by varying the symmetry of the AC signal used to drive the load. The upper and lower drivers 14, 16 are driven complementarily by the output of the pulse width modulator. At any given time, one of the upper and lower switches 18, 20 is conducting, with a minimum of crossover dead time. As shown in FIG. 2A, at a 50 percent duty cycle, the complementary action of the upper and lower switches results in a symmetrical signal. As shown in FIG. 2B, as the duty cycle varies away from 50 percent, the AC waveform becomes increasingly asymmetric, although the base frequency remains constant.

Being frequency selective, the RLC circuit into which the load is connected responds mainly to whatever component of energy is present at the resonant frequency, while being relatively unaffected by components of harmonic frequencies. Maximum current is delivered to the load where the power signal is symmetrical, i.e., where the duty cycle of the pulse-width modulator is 50 percent. Where the duty-cycle falls diverges away from 50 percent in either direction, less current is delivered to the load $R_L$ because there is a lower value of energy at the fundamental frequency.

FIGS. 2C and 2D illustrate an alternative approach using symmetry control, but with variable frequency. Although this approach can be realized with integrated circuits and FETs, it can also be realized more simply, by using a self-oscillating circuit with an upper and a lower bipolar transistor. The lower transistor is turned off early to cause the shift in symmetry. The on-time of the upper transistor is relatively constant, so the overall frequency is increased as the lamps are dimmed. The primary means of dimming is the symmetry control, and the frequency shift is incidental. The frequency shift does aid in the dimming, but it has a minor effect in a circuit with a low Q. In certain prior-art, frequency-controlled circuits, Q is relatively high; the prior art circuits require about a 10 percent change in frequency to achieve full dimming. In the self-oscillating circuit illustrated in FIGS. 2C and 2D, there is more than a 50 percent change in frequency, but due to the low Q, the frequency change has only a minor effect.

Returning to the waveforms shown in FIGS. 2A and 2B, the operation and design of the circuit can be better understood by considering the mathematical relationships that govern the various circuit components.

The impedance Z of a series RLC circuit, such as that used for the output stage of the ballast circuit shown in FIG. 1, can be expressed by the following formula:

$$Z = j\omega L + \frac{1}{j\omega C} + R \tag{1}$$

The circuit is in resonance where Im(Z)=0, that is, at that frequency $\omega_0$ where the impedance has no imaginary component. For the series RLC circuit shown $$\omega_0 = \frac{1}{\sqrt{LC}} \tag{2}$$

By voltage division, the voltage transfer function is determined by the following formula:

$$\frac{V_{OUT}}{V_{IN}} = \frac{R}{j\omega L + \frac{1}{j\omega C} + R} = \frac{j\omega RC}{1 - \left(\frac{\omega}{\omega_0}\right)^2 + j\omega RC} \tag{3}$$

This leads to the following relationship:

$$\left|\frac{V_{OUT}}{V_{IN}}\right|^2 = \frac{a}{Q^2(1-a)^2 + a} \tag{4}$$

where the relative frequency a, and the quality factor Q are defined as follows:

$$a \doteq \left(\frac{\omega}{\omega_0}\right)^2 \tag{5}$$

where $$Q = \frac{1}{R}\sqrt{\frac{L}{C}} \tag{6}$$

$$\omega_0^2 \doteq \frac{1}{LC} \tag{7}$$

These relationships can be used to express the power transfer sensitivity of the circuit:

$$P_{OUT} = P_{REF} \cdot \frac{Q \cdot a}{[Q(1-a)]^2 + a} \tag{8}$$

where $$P_{REF} \doteq \frac{|V_{IN}|^2}{\sqrt{\frac{L}{C}}} \tag{9}$$

Equation (8) is then differentiated with respect to a to determine the value of a that yields the maximum value of $P_{OUT}$:

$$\frac{dP_{OUT}}{da} = P_{REF} \cdot \frac{Q \cdot [Q(1-a)]^2 + Q \cdot a - Qa[2Q^2(1-a) + 1]}{\{[Q(1-a)]^2 + a\}^2} = 0 \tag{10}$$

Solving for a yields a=1, or resonance. Thus, the maximum power is transferred to the load at resonance.

In order to determine the optimal value for Q, equation (8) is differentiated with respect to Q:

$$\frac{dP_{OUT}}{dQ} = P_{REF} \cdot \frac{a[Q(1-a)]^2 + a^2 - Qa(1-a)^2 \cdot (2Q)}{\{[Q(1-a)]^2 + a\}^2} = 0 \tag{11}$$

Solving this equation leads to the following relationship between a and Q:

$$a = Q^2(1-a)^2 \tag{12}$$

and $$Q_{MAX} = \frac{\sqrt{a}}{|1-a|} \tag{13}$$

Substituting equation (12) into equation (8) yields the following relationship:

$$P_{OUT} = P_{REF} \cdot \frac{Q}{2} \tag{14}$$

In FIG. 3, $P_{OUT}/P_{REF}$ is graphed against Q to show the design point for optimum power transfer.

Substituting for Q and $P_{REF}$ in equation (14) using equations (7) and (9) yields the following value for the maximum value for $P_{OUT}$:

$$P_{OUT/MAX} = \frac{|V_{IN}|^2}{2 \cdot R} \tag{15}$$

The mathematical relationships among the circuit components can also be used to analyze the switching considerations of the symmetry control circuit:

$$Z_{IN} = j\omega L + \frac{1}{j\omega C} + R = R + j\omega L\left[1 - \left(\frac{\omega_0}{\omega}\right)^2\right] \tag{16}$$

The phase angle thus can be expressed as follows:

$$\phi_{Z_{IN}} = \left[1 - \left(\frac{\omega_0}{\omega}\right)^2\right] \cdot \frac{\omega L}{R} \tag{17}$$

The phase angle should be positive, so $$1 - \left(\frac{\omega_0}{\omega}\right)^2 > 0; \left(\frac{\omega_0}{\omega}\right)^2 < 1 \tag{18}$$

Thus, $$\therefore \left(\frac{\omega}{\omega_0}\right)^2 = a > 1 \tag{19}$$

From these relationships, it can be concluded, first, that the circuit needs to work above resonance. Second, the circuit needs to work close to resonance for maximum efficiency.

These relationships are used in the choice of appropriate values for the components of the RLC circuit. For example, in a typical two-lamp circuit: $V_{DC}$=270 V, $V_{IN}$=135 V RMS, and $V_{OUT\ (OPEN\ CIRCUIT)}$=600 V RMS. The transformer turn ratio n is 600/135=4.45 and $Z_{LOAD}$=1470Ω. Therefore:

$$R = \frac{Z_{LOAD}}{n^2} = 74\Omega \tag{20}$$

$P_{OUT}$=62 W. Equation (8) is then applied (restated for ease of reference):

$$P_{OUT} = \frac{V_{IN}^2}{R} \cdot \frac{a}{[Q(1-a)]^2 + a} \tag{21}$$

Thus, $$\frac{a}{[Q(1-a)]^2 + a} = \frac{P_{OUT} \cdot R}{V_{IN}^2} = 0.25 \tag{22}$$

for a=1.5, Q=4.24. Applying the known relationships among Q, R, L, C, and $f_0$, C=22 nF; L=2 mH, and f=30 kHz.

In a second example: $V_{DC}$=550 V, $V_{IN}$=275 V RMS. The transformer ratio is 2.18. $Z_{LOAD}$=1470Ω, and R now becomes 310Ω. $P_{OUT}$=62 W. For a=1.5, Q=4.24, and the following values are computed: C=4.7 nF; L=8.12 mH and f=31 kHz.

Figure 4:
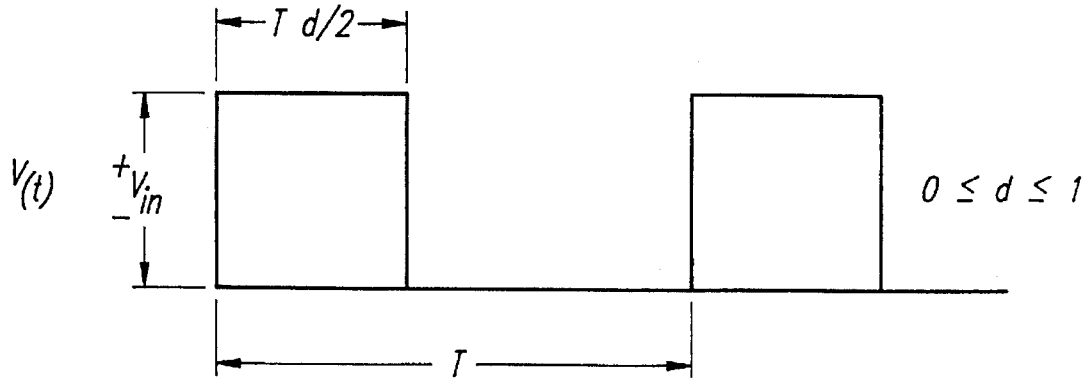
FIG. 4 is a graph of a pulsating DC input waveform according to the present invention. The DC component is subsequently removed by a series capacitor.

The concept of symmetry control can be better understood by considering a Fourier analysis of the input waveform. FIG. 4 shows a graph of the waveform, redrawn so that the bottom edge is coincident with the time axis. The $a_0$ term is ignored, because the average is actually zero.

As discussed above, in the present embodiment, the control system functions by modifying the duty cycle of the pulse signal, i.e., by changing the width of each pulse while maintaining the same frequency. Further, as discussed below, the duty cycle never exceeds 50 percent.

Thus, if the dimmer input ranges between 0 and 1, inclusive, and the period of the pulse signal is T, then the width of the signal can be expressed by the following equation:

$$\text{Pulse Width} = T\frac{d}{2} \tag{23}$$

The amplitude of the signal is defined to be $V_{IN}$. Thus, the Fourier coefficients for the square wave shown in FIG. 4 are as follows:

$$a_n = V_{IN}\frac{2}{T}\int_0^{T\frac{d}{2}} \cos\left(\frac{2\pi nt}{T}\right) dt = \frac{V_{IN}}{n\pi}\sin(dn\pi) \tag{24}$$

-continued $$b_n = V_{IN}\frac{2}{T}\int_0^{T\frac{d}{2}} \sin\left(\frac{2\pi nt}{T}\right) dt = \frac{V_{IN}}{n\pi}[1-\cos(dn\pi)] \tag{25}$$

The pulse signal can therefore be expressed as the following Fourier series:

$$V(t) = \sum_{n=1}^{\infty} \frac{V_{IN}}{n\pi}\left[\sin(dn\pi)\cos\left(\frac{2\pi n}{T}t\right) + \left(1-\cos(dn\pi)\sin\left(\frac{2\pi nt}{T}\right)\right)\right] \tag{26}$$

or:

$$V(t) = \sum_{n=1}^{\infty} \frac{V_{IN}}{n\pi}\sqrt{2-2\cos(dn\pi)}\cos\left(\frac{2\pi nt}{T} + \phi\right) \tag{27}$$

Figure 5:
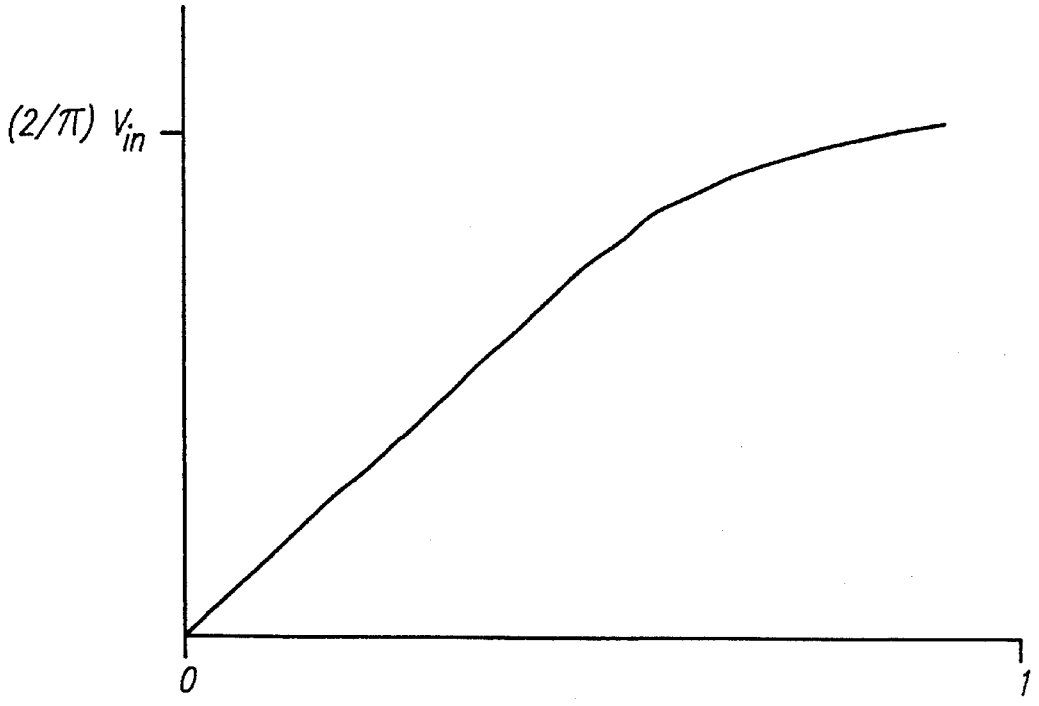
FIG. 5 is a graph showing the relationship between the duty cycle of the pulse width modulator and the magnitude of the fundamental frequency of the AC waveform.

Thus, the resonant RLC circuit acts as a low-pass filter between V(t) and the load, the bulk of the power being transferred by the fundamental. If Q is low enough, the second harmonic is strong enough to cause noticeable asymmetry in the output. FIG. 5 is a graph showing the proportional relationship between d and the amplitude of the fundamental. The relationship between the pulse duration and the output power is quadratic because of the $V_{IN}^2/R$ factor.

A similar mathematical analysis can be performed on the waveforms shown in FIGS. 2C and 2D to reach similar results.

Figure 6A:
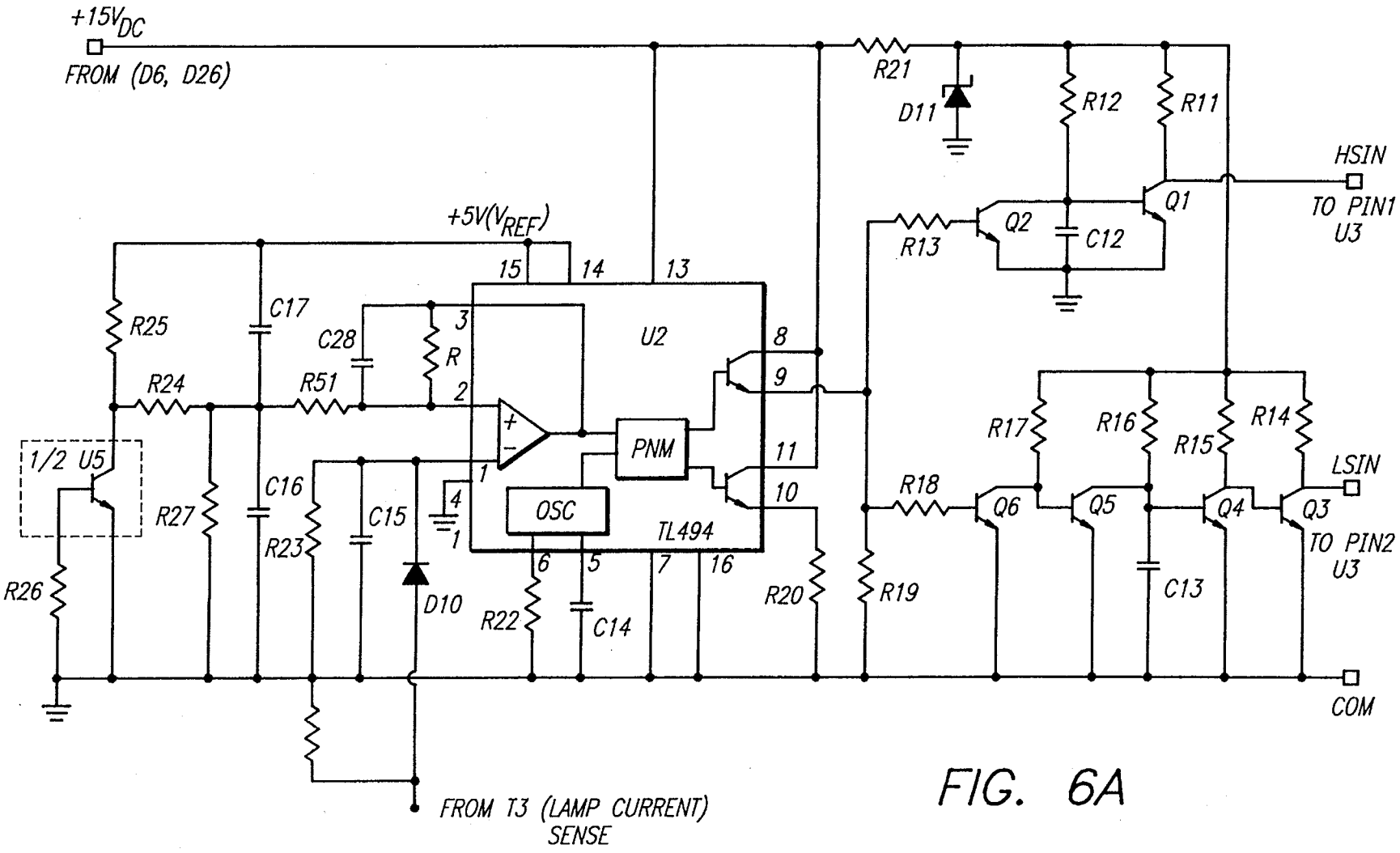
FIGS. 6A–D are circuit diagrams showing a preferred embodiment of a ballast circuit according to the present invention.
Figure 6B:
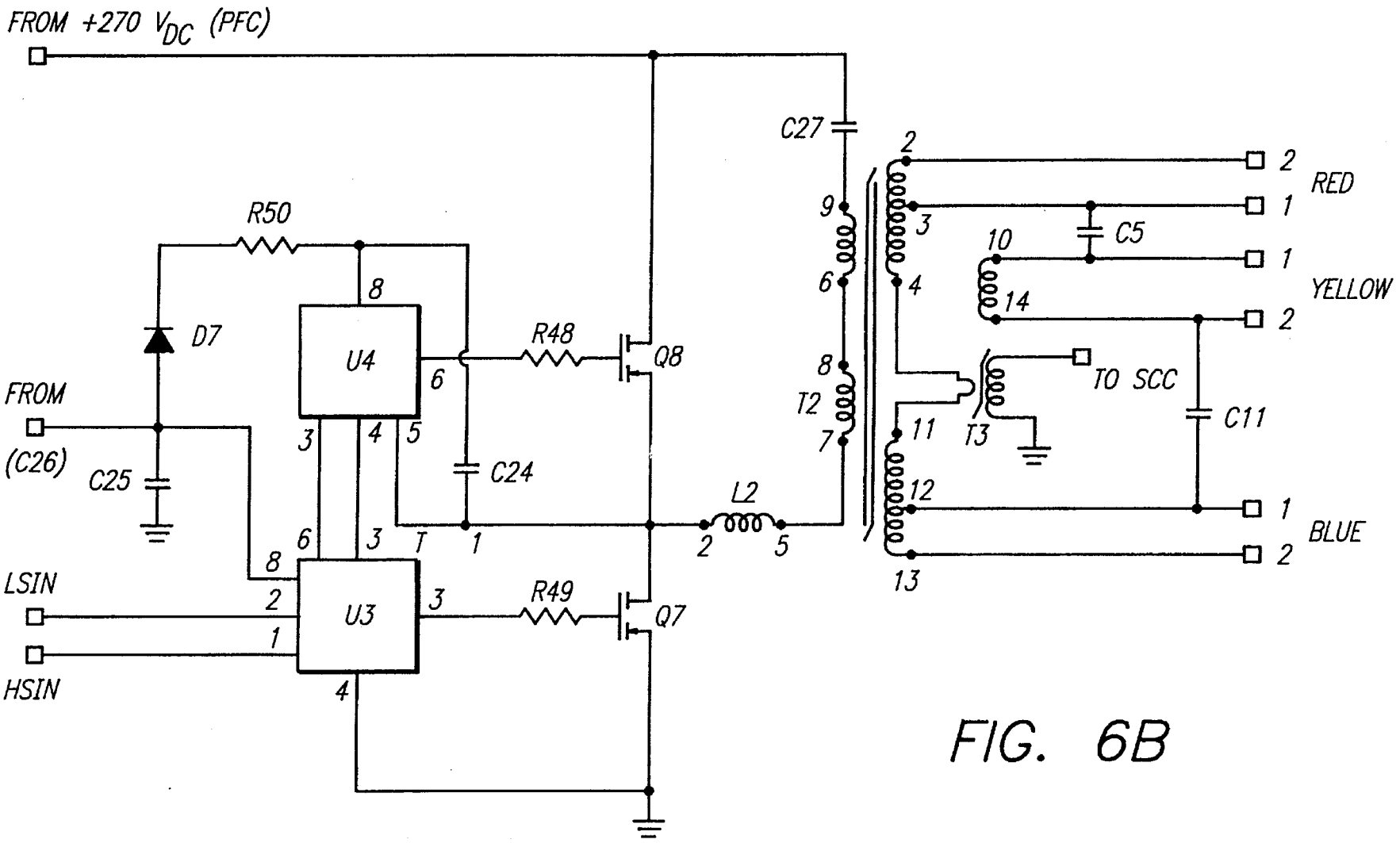
Figure 6C:
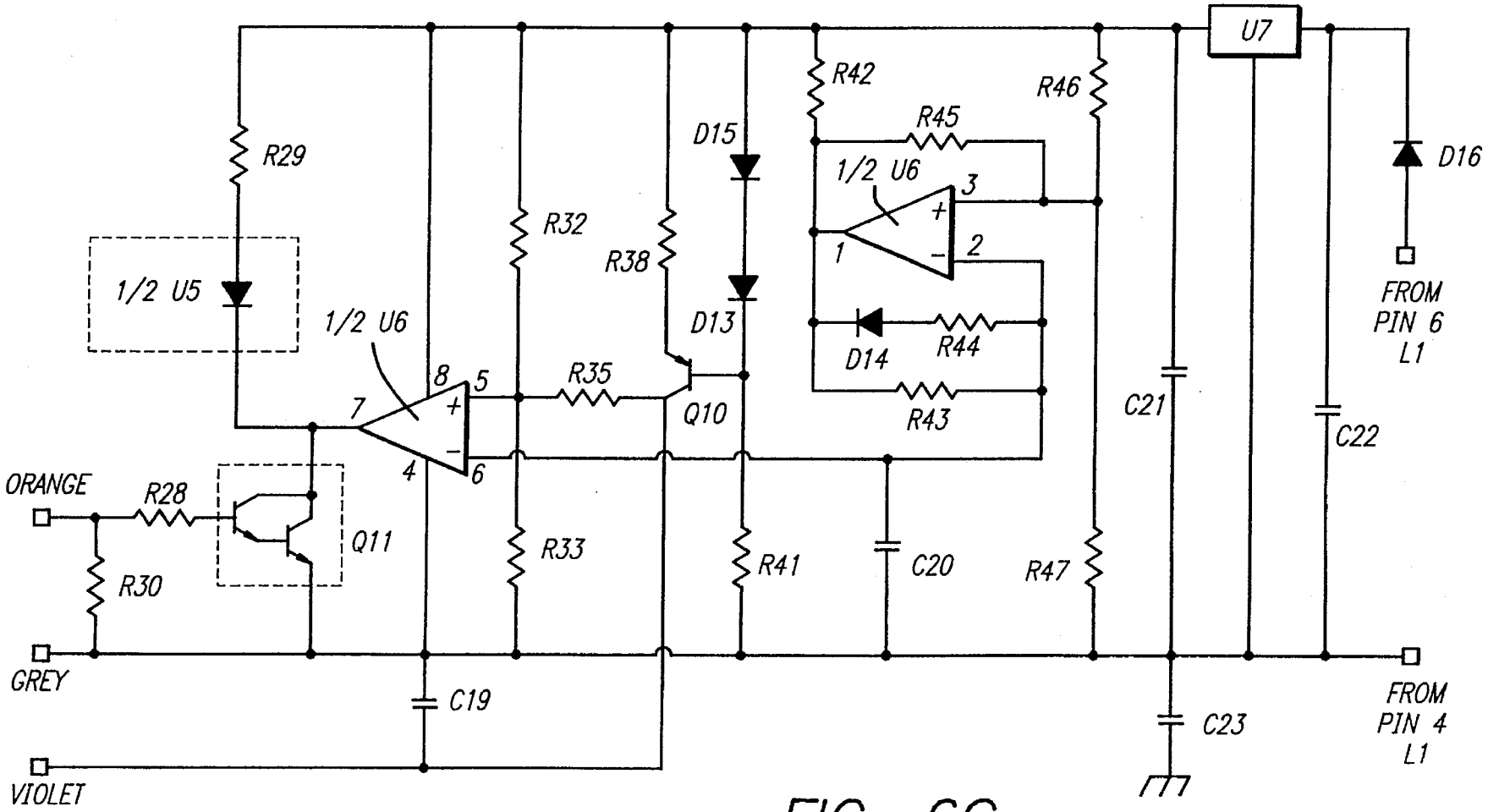
Figure 6D:
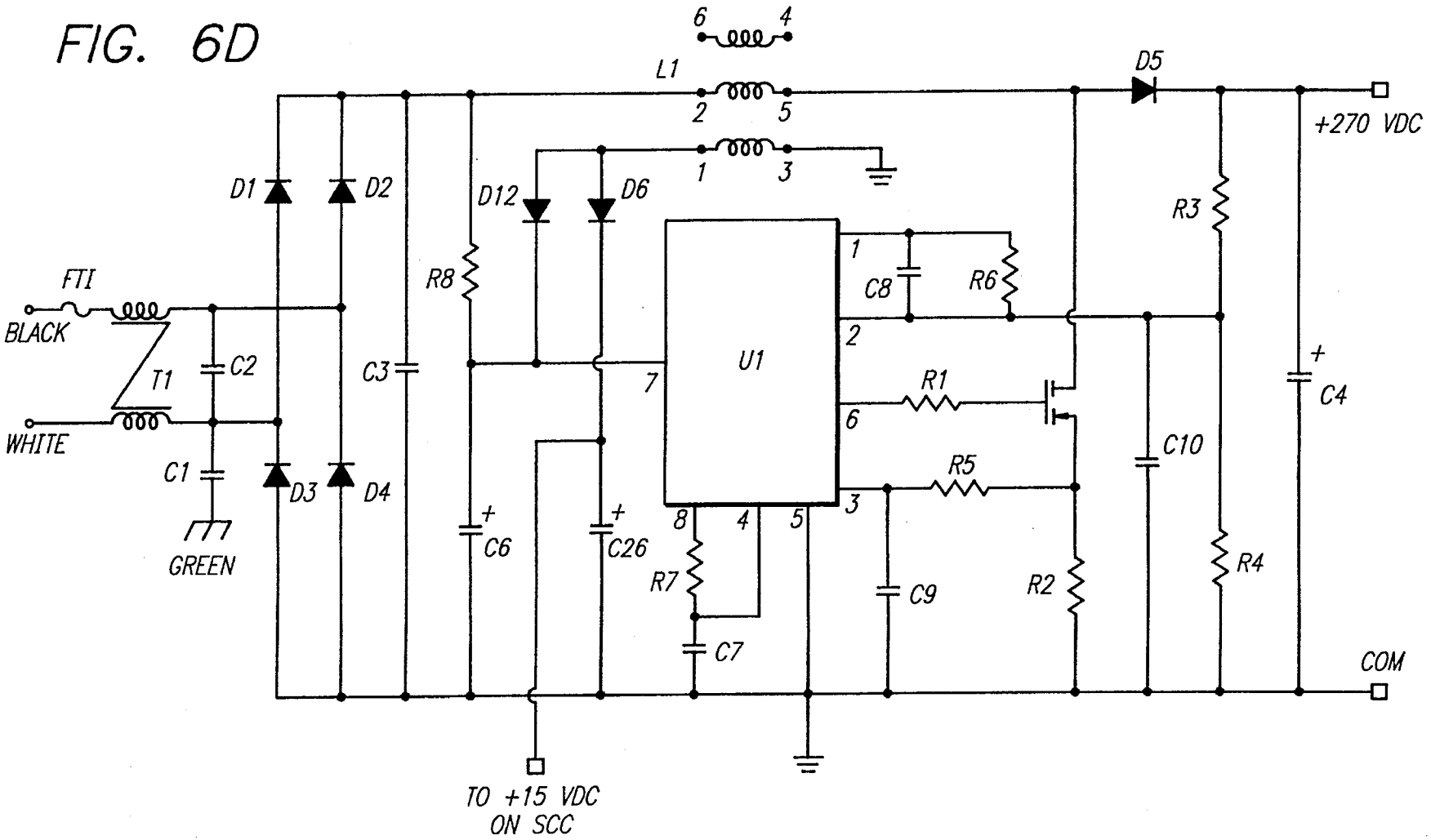

FIGS. 6A–D show a preferred embodiment of a gas discharge lamp ballast circuit incorporating the symmetry control concept described above. The circuit includes a symmetry control circuit (FIG. 6A), a series resonant converter (FIG. 6B), a dimming interface circuit (FIG. 6C), and a boost PFC circuit (FIG. 6D).

In the symmetry control circuit shown in FIG. 6A, the FIG. 1 constant frequency oscillator 11 and pulse width modulator 10 are contained in a single integrated circuit U1, which may be any of a number of commercially available integrated circuits that are capable of driving a single-ended circuit, such as a flyback circuit, in a duty-cycle modulated mode. The pulse width modulator used must be of a type that limits the duty cycle to 50 percent. To go above that percentage has the same effect as going below that percentage, inasmuch as the 50 percent point in either direction produces a waveform that has a progressively lower value of energy at the fundamental frequency. Using a pulse-width modulator with limits beyond 50 percent would result in a control characteristic with a phase reversal at its midpoint, making closed loop control impossible.

In FIG. 6A, integrated circuit U1 is a Motorola TL494 switchmode pulse width modulation control circuit. The frequency of the TL494 oscillator $f_{OSC}$ is determined by resistor R22 at pin 6 and capacitor C14 at pin 5, according to the following formula:

$$f_{OSC} \approx \frac{1 \cdot 1}{R_{22} \cdot C_{14}} \tag{28}$$

In the present preferred embodiment, a suggested value for $f_{OSC}$ is 26–27 kHz, which remains constant throughout the operation of the control circuit.

The output of the oscillator is fed into the pulse width modulator. Output control pin 13 is tied to a 15 V DC supply, which limits the duty cycle of the PWM to a range of 0 to 48 percent. Within that range, the duty cycle is determined by the inputs at pins 1 and 2, which feed into a differential amplifier. As discussed further below, pin 2 receives a dimming level signal from the dimmer interface circuit shown in FIG. 6C, and pin 1 receives a feedback control signal from the current sensing means in the series resonant converter shown in FIG. 6B. Because the resistance of gas discharge lamps is non-linear, the resonant RLC circuit into which the lamps are connected displays a certain amount of reflected capacitance. This in turn means that when the maximum voltages are applied to the load, the amount of current flowing through the load tends to flatten out. Because of the feedback arrangement, the IC tends to flatten the duty cycle accordingly.

The TL494 provides complementary output transistors at pins 8–9 and 10–11 for a pulse output signal ranging from 0 V to +15 V. As only one transistor is needed, the collector of the second transistor at pin 11 is tied to the 15 V DC supply, and the emitter at pin 10 is tied to ground via resistor R20, in order to keep it stable.

As discussed in greater detail below, the output of the PWM is used to actuate both the lower and upper drivers U3, U4 in the series resonant converter shown in FIG. 6B. The upper driver U4 inverts the pulse signal, so that at any given time, either the lower switch Q7 or the upper switch Q8 is conducting. The lower driver and switch create the lower half of the AC waveform, and the upper driver and switch create the upper half. Thus, where the duty cycle of the PWM approaches 50 percent, the AC waveform is symmetrical. As the duty cycle approaches 0 percent, the output of the control circuit becomes increasingly asymmetrical.

In order to prevent damage to circuit components, it is essential that the lower switch Q7 and the upper switch Q8 never conduct at the same time. This is accomplished through the introduction of a delay, or dead time, between the actuation of the lower driver U3 and the upper driver U4. The particular ICs chosen to perform the function of upper and lower driver in the present embodiment in fact have built into them a certain amount of dead time. However, it has been found to be desirable to build additional dead time into the circuit through the use of an upper transistor network Q1–Q2 that feeds the pulse signal to the upper driver U4, and a lower transistor network Q3-Q4-Q5-Q6 that feeds into the lower driver U3.

When the pulse signal goes high, the lower transistor network lags behind the upper transistor network by approximately one microsecond before each network passes a high signal to its respective driver. When the pulse signal goes low, it is the upper transistor network that lags behind the lower transistor network by approximately one microsecond before each network passes a low signal to its respective driver.

Specifically, when the pulse signal goes high, transistor Q2 conducts, causing capacitor C12 to discharge through Q2. The drop in voltage causes transistor Q1 to shut off. No longer grounded, the voltage at the collector of Q1 now rises to 15 V, and $HS_{IN}$ is HIGH.

At the same time, when the pulse signal goes high, transistor Q6 conducts, causing transistor Q5 to turn off, allowing C13 to rise to the $V_{BE}$ of transistor Q4, thus causing transistor Q4 to turn on. This causes transistor Q3 to turn off, and causes the voltage at the collector of Q3 to rise to 15 V. $LS_{IN}$ is now HIGH, but delayed by approximately one microsecond after $HS_{IN}$, because of the time needed for C13 to reach $V_{BE}$ of Q4.

When the pulse signal goes low, transistor Q2 shuts off, allowing C12 to charge until it reaches $V_{BE}$ of transistor Q1. When transistor Q1 starts to conduct, the voltage at its collector drops to 0, and $HS_{IN}$ is now LOW. The time required to charge capacitor C12 introduces a delay of approximately one microsecond.

At the same time, when the pulse signal goes low, transistor Q6 no longer conducts. Transistor Q5 now conducts, shorting capacitor C13 to ground. Q4 turns off, and Q3 now turns on, causing the voltage at its collector to drop to 0 V, virtually instantaneously.

As shown in FIG. 6B, the two outputs $HS_{IN}$ and $LS_{IN}$ are used to actuate an IC lower driver U3 and upper driver U4 that operate in conjunction with two FETs Q7 and Q8 and a +270 V DC supply in a half-bridge inverter configuration. The low-voltage square-wave signal made up of $HS_{IN}$ and $LS_{IN}$ is converted into a high-voltage signal that drives a lamp load connected into a resonant RLC circuit. The resonant circuit of FIG. 6B is essentially series loaded after the lamps have struck. In the present embodiment, U3 and U4 are paired Power Integrations low-side and high-side driver ICs, PWR-INT200 and PWR-INT201. These ICs are desirable because they provide a simple, cost-effective interface between the low-voltage control circuitry and the high-voltage load.

In order to take advantage of complementary control circuitry built into U3 and U4, both $LS_{IN}$ and $HS_{IN}$ are fed into U3. $HS_{IN}$ is then passed from pins 6 and 5 of U3 onto pins 3 and 4 of U4, respectively, and is inverted. U3 and U4 also introduce dead time, which supplements the dead time created by upper and lower transistor networks shown in FIG. 6A. C24 provides a bootstrapping function for U4.

Drivers U3 and U4 alternately cause FETs Q7 and Q8 to conduct, thereby generating a signal through capacitor C27, inductor L2, and output transformer T2, as well as through the components on the load side of output transformer T2. Output transformer T2, serves to isolate the load from the drive circuitry, in accordance with UL requirements. By design, the series resonant converter uses the impedance of the output capacitors C5 and C11, reflected through the isolating transformer T2.

As shown in FIG. 6B, connectors are provided for two gas discharge lamps, the first connected between the RED and YELLOW terminals and the second, between the YELLOW and BLUE terminals. As discussed above, maximum power would be delivered to the load where the RLC circuit is tuned to the frequency of the oscillator, in this case 26–27 kHz. However, in the present embodiment, the natural resonance chosen for the RLC circuit is 22 kHz, rather than 26–27 kHz, in order to avoid the uncontrolled situation arising where the resonance is at the maximum voltage.

In FIG. 6B, the gas discharge lamp between RED and YELLOW is connected in parallel with capacitor C5, and the gas discharge lamp between YELLOW and BLUE is connected in parallel with capacitor C11. Although it is possible to practice the symmetry control aspect of the present invention with capacitors C5 and C11 connected in series with the lamp load, the present arrangement is advantageous. First, it permits one-lamp operation. If one of the two lamps burns out, its associated capacitor will act as a shunt, permitting some current to continue to flow through the remaining lamp. In prior art drive circuits, the failure of one of the lamps would result in the cessation of current flow through both lamps. In addition, the present arrangement has the added advantage of making immediately apparent which of the two lamps needs to be replaced.

A current sensing transformer T3 provides a feedback control signal back to the pulse width modulator in FIG. 6A. As shown in FIG. 6A, the signal generated by transformer T3 is converted to DC via diode D10, resistor R23, and capacitor C15. Resistor R23 also acts as a load for averaging purposes, and thus the voltage generated at pin 1 of U2 is proportional to the current flow through the lamp load.

Integrated circuit U2 provides a differential amplifier at pins 1 and 2. The differential amplifier is used to compare the feedback control signal at pin 1 with a dimmer level signal at pin 2. In the present embodiment, the symmetry control circuit receives the dimmer level signal from the dimming interface circuit shown in FIG. 6C via phototransistor U5, which is coupled with an output LED on the dimming interface circuit.

When the transistor of U5 is fully off, the maximum voltage that can be developed at pin 2 is determined by R25, R24, R27, filter C16, and R51. As the transistor of U5 goes on, the voltage at pin 2 decreases. When the transistor of U5 is fully conducting, the voltage at pins 2 and 3 drops to approximately 3 V.

Any difference between the dimming level signal at pin 2 and the feedback control signal at pin 1 is amplified by the differential amplifier, and then fed back to pin 2 through pin 3, resistor R and capacitor C28. Because of this feedback arrangement, pins 1 and 2 are always at the same voltage.

FIG. 6C shows a preferred embodiment of a dimming interface circuit according to the present invention. A first comparator is used to generate a sawtooth waveform. A second comparator generates a PWM signal based on a comparison of the sawtooth waveform with a voltage established by input from a controller supplied by the operator. The controller may be either of the two types of commonly available controllers, resistor or voltage source. Means are also provided for applying a PWM signal directly to the output stage of the circuit. The output of the dimming interface circuit is then fed to the FIG. 6A symmetry control circuit through transistor U5, where it is used to create the dimming level signal at pin 2 of the controller U2.

An AC power signal is supplied to the circuit through transformer L1 of the boost PFC circuit, shown in FIG. 6C, and is rectified by diode D16. The rectified signal is then fed to a voltage regulator U7, which in the present embodiment is a Motorola 78L15A three-terminal medium current positive voltage regulator. Bypass capacitors C21 and C22 are provided at the input and output of the regulator.

U6 is the first half of a 393 dual comparator, which is configured along with capacitor 20, diode D14, and resistors R42, R43, R44, R45, R46, and R47 to generate a sawtooth waveform that is fed to pin 6 of the second half of the 393 dual comparator. The sawtooth waveform is created as capacitor C20 charges and discharges.

The controller, either resistor or voltage source, is connected between terminals GREY and VIOLET. The voltage at pin 5 of the second half of the dual comparator is forced to the voltage between terminals GREY and VIOLET, the voltage being scaled down by resistors R32, R33, and R35.

Where a resistor controller is connected between terminals GREY and VIOLET, resistor R38 and transistor Q10 provide a constant current source, with diodes D15 and D13 and R41 supplying the needed base voltage for transistor Q10. The voltage across connectors GREY and VIOLET is created as the current passes through the controller resistor.

At pin 5, the reference voltage, which is proportional to the voltage between connectors GREY and VIOLET is compared with the sawtooth waveform at pin 6. The differential amplifier U6 will generate an output signal determining a duty cycle and a pulse width relating to the amount of time that sawtooth waveform is above the DC voltage signal supplied by the controller. The output is then fed via LED U5 to phototransistor U5 in the symmetry control circuit, as described above. The level of the output of the dimming interface circuit is controlled by varying the resistance of the controller.

If a voltage source controller is used, then the current source is disabled, as transistor Q10 shuts off. The controller voltage is fed to pin 5 through resistor R35, and the level of the output of the differential amplifier is controlled by varying the voltage supplied by the controller.

Finally, if the user has neither a resistor or voltage source controller, but has a controller for generating a PWM signal, Darlington pair Q11 is provided as a high-impedance input stage. The incoming PWM signal is fed directly to diode U5, bypassing the differential amplifier completely.

FIG. 6D shows a preferred embodiment of a boost PFC circuit according to present invention. The boost PFC circuit plays the role of a line conditioner by performing the power factor and harmonic distortion corrections, and provides stable DC bulk voltages used by various circuit components as described below.

The boost PFC circuit receives a standard 60 cycle AC input at terminals BLACK and WHITE. The first stage of the boost PFC circuit is an EMI filter, comprising a common mode choke T1 and capacitors C1 and C2. The differential mode impedance of the filter is built up by the leakage inductance of T1.

Diodes D1, D2, D3, and D4 are configured as a bridge rectifier, the output of which is filtered by capacitor C3. The value of C3 is kept small so as not to create distortion in the line current or otherwise interfere with the operation of the boost converter.

The required DC voltages are created by a current mode PWM controller U1 in a "flyback" configuration. The controller used in the present embodiment is a Unitrode UC3845. However, it will be apparent to a practitioner of ordinary skill in the art that it would be possible to substitute other similar circuits without departing from the spirit of the invention.

The $V_{CC}$ of the controller U1 is supplied by capacitor C6, which functions as a DC filter and as a storage capacitor, and which is charged initially by current flowing through resistor R8. $V_{CC}$ is maintained by transformer L1 and diode D12.

The controller U1 includes an oscillator, operating at a fixed frequency determined by the values of resistor R7 and capacitor C7 connected to pins 4 and 8. The basic advantage of keeping the frequency constant is the minimization of the EMI energy spectrum. In the present embodiment, the free-running frequency of controller U1 is chosen to be 33 kHz.

The pulse signal output of the oscillator is fed out of pin 6 to a FET through resistor R1. With each pulse, the FET turns on, pulling the primary coil of transformer L1 to ground. The current through the primary coil is a ramp during the time of the pulse, and when the FET turns off, the primary coil's voltage rises to maintain the current. Charge is thus continuously fed to storage capacitor C4 through diode D5 to reach the desired level of 265–270 V DC.

Pursuant to the principle of power factor correction, current sensing and voltage sensing are used to maintain a proportional relationship between the instantaneous line voltage and the current charging the inductor L1, which consequently will be transferred to the load. The mathematical relationship governing the circuit operation is:

$$V \cdot \Delta t = L \cdot \Delta I \tag{29}$$

Voltage regulation is accomplished through feedback provided to controller U1 through resistors R3, R4 and R6, and capacitors C10 and C8. Resistors R3 and R4 are configured as a voltage divider where resistor R3 has a significantly higher resistance than resistor R4. Capacitor C10 acts as a low-pass filter to filter out noise, as the signal is fed to pin 2, which is the input of the controller's error amplifier. The error amplifier compares the input from the voltage divider against an internal reference voltage of 2.5 V. The controller then outputs the result of the comparison through pin 1. Feedback is provided to the error amplifier through resistor R6 and capacitor C8. The internal logic of the controller will terminate the duty cycle to maintain the output voltage constant, i.e., load regulation.

The circuit further provides a feedback arrangement through resistors R2 and R5 and capacitor C9 for insuring current-mode operation. The duty cycle of the oscillator output is variable, and is controlled by a current sensing resistor R2 that is fed back to pin 3. The duty cycle starts at about 10 percent near zero crossing and reaches a maximum of 50 percent at the peak of the line voltage. When the voltage across R2 exceeds the reference voltage of the controller, then the duty cycle is terminated. This prevents transformer L1 from going into current saturation mode. Resistor R5 and capacitor C9 perform an integration function, and act as a high frequency filter. The basic rule in choosing values for R5 and C9 is:

$$R5 \cdot C9 < \text{Period of PRR} \tag{30}$$

In the present embodiment, the period chosen is approximately 15 microseconds.

Correspondingly lower voltages are developed in the upper and lower secondary coils of transformer L1. The AC signal induced in the lower secondary coil is rectified by diodes D12 and D6 and is used to charge capacitors C6 and C26 to 15 V. The voltage thus developed is used to power the boost PFC circuit controller U1, and controller U2 in the FIG. 6A symmetry control circuit.

The AC signal induced in the upper secondary coil is fed to the FIG. 6C dimming interface circuit, where it is rectified by diode D16. The voltage stored on capacitor C22 is then fed to regulator U7, as discussed above.

Figure 7:
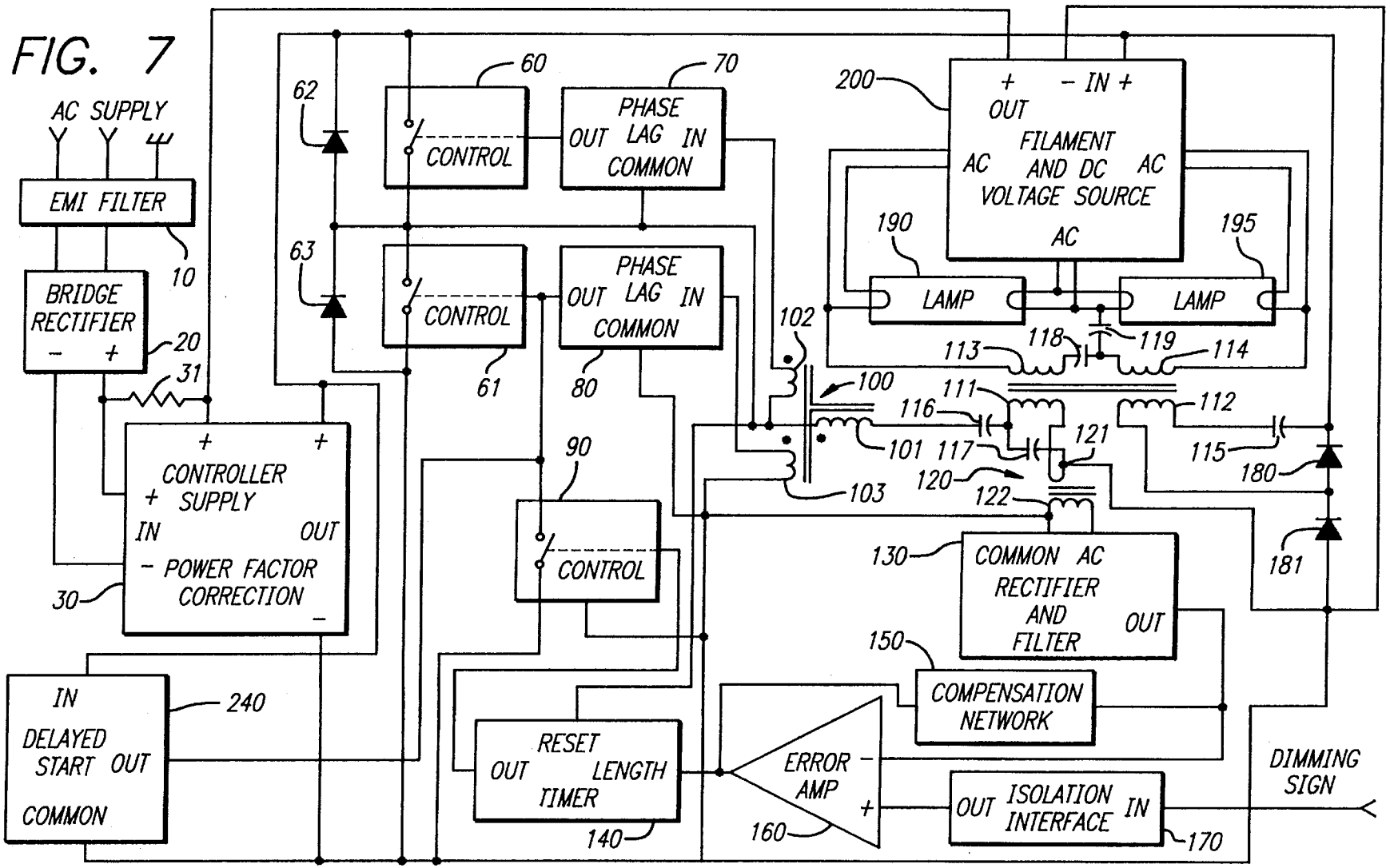
FIG. 7 is a circuit diagram of an alternative preferred embodiment of a ballast circuit according to the present invention, in which the circuit is self-oscillating.

FIG. 7 shows an alternative preferred embodiment of the present invention, in which the circuit is self-oscillating, and which therefore does not require an independent pulse generator. The use of a self-oscillating circuit is advantageous because it naturally adjusts its operating frequency to be above the resonant frequency for any load, which allows the use of a relatively small capacitance in parallel with the output transformer so that the no-load resonant current will be acceptably small. Self-oscillating circuits can be operated with symmetry control by forcing one of the switches to turn off early, creating waveforms such as those shown in FIGS. 2C and 2D. This, of course, causes the operating frequency to increase. The "on" time of the switch that is operating naturally may vary a little as the turn-off time of the other transistor switch is varied.

As shown in FIG. 7, the self-oscillating symmetry controlled ballast circuit receives line AC voltage as an input. The AC voltage is passed through EMI filter 10, and is then fed to a bridge rectifier 20, which charges a bulk capacitor internal to power factor correction circuit 30 to the peak value of the rectified line voltage. This voltage appears between the positive and negative output terminals of power factor controller 30, which is connected to the input of filament and DC voltage source 200. An oscillator internal to filament and DC voltage source 200 immediately starts oscillating. This oscillator has an AC voltage that is rectified to produce a DC output voltage. The DC output of circuit 200 provides a voltage to the controller supply input of power factor controller 30, which is almost high enough to cause the controller IC internal to circuit 30 to begin functioning. Resistor 31 supplies a charging current that quickly brings the controller supply voltage to the point at which the controller IC begins to operate.

The controller IC begins to operate within about 100 milliseconds after power is applied to the circuit. For a 120 V rated ballast, the regulated output of power factor controller 30 is preferably 270 V DC. Once the 270 V supply is operating, then the AC outputs of circuit 200 supply an AC voltage of about 4 V to preheat the filaments of lamps 190 and 195. After approximately one second from the time that the power was applied to the ballast, delayed start circuit 240 supplies a starting pulse to switch 61, which causes the main oscillator circuit to begin operating.

The main oscillator produces a square-wave voltage at the junction of inverter switches 60 and 61. An LCC resonant circuit comprising inductor 100, and capacitors 116 and 117 forms a low-pass filter to remove most of the harmonic components of the square wave so that the lamp current is essentially sinusoidal. The symmetry of the square wave is adjusted to control the level of the fundamental component of the square wave, thereby controlling the lamp current. The RMS value of the fundamental component $V_1$ is given by the following equation:

$$V_1 = V_{dc}\frac{\sqrt{2}}{\pi}\sin(\pi d)$$

where $V_{dc}$ is the output voltage of the power factor correction circuit, and d is the duty cycle, which ranges from 0.0 to 0.5.

The resonant frequency of the LCC circuit depends on the load impedance reflected through transformer 110. When the lamps are operating, the reflected impedance presented at winding 111 is low compared to the impedances of inductor 100 and capacitors 116 and 117. Capacitor 117 is several times smaller than capacitor 116, so the LCC circuit essentially functions as a series-loaded LCR circuit. Before the lamps have struck, the series combination of capacitor 116 and 117 is dominated by the smaller capacitor 117 so the resonant frequency is higher than when the lamps are operating.

A fraction of the voltage across inductor 100 is coupled back to the inverter switches through windings 101 and 103. The feedback voltage for each switch is passed through a phase lag circuit so that each switch will not turn on until after a short interval following the time when the other switch turns off. The phase lag must be small enough that the switch will turn off before the current in inductor 100 drops to zero. This allows the voltage across the switch that is turn on to drop to zero due to the action of inductor 100 before the switch turns on. When the voltage across an inverter switch drops to zero, the anti-parallel diode (62 or 63) conducts the inductor current until the current reverses. When the phase lag circuit is properly designed, the switches will operate at a frequency above the resonant frequency of the LCC circuit, whatever it is. This causes the circuit to always operate in the inductive mode, which produces zero-voltage switching for switches 60 and 61.

Capacitor 118 prevents DC current from flowing through windings 113 and 114. Capacitor 118 allows a small current to flow through one lamp if the other lamp is removed or is inoperative.

Winding 112, in conjunction with capacitor 115 and diodes 180 and 181, allows the open circuit voltage of the ballast to be clamped to a predetermined value.

The lamp load current is reflected to winding 111 and is sensed by the primary winding 121 of current transformer 120. The current at secondary winding 122 is rectified and filtered by circuit 130. The rectified current signal is compared by error amplifier 160 to a reference voltage produced by isolation interface 170. Compensation network 150 stabilizes the lamp current control loop.

Dimming is accomplished by turning off switch 61 with switch 90 before switch 61 is naturally turned off by winding 103. Timer 140 is reset when switch 61 turns off, and the voltage across switch 61 drops towards zero. After an interval determined by the voltage at the LENGTH input of timer 140, switch 90 is turned on, thereby turning off switch 61. Increasing the voltage at the LENGTH input increases the duty cycle of switch 61 up to the maximum value of 50 percent that naturally occurs without switch 90.

While the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

What is claimed is:

1. A circuit for controlling the flow of current through a load, comprising:

oscillator means for generating a pulse signal of constant frequency;

pulse width modulator means for varying the duty cycle of the pulse signal;

converter means for receiving the modulated pulse signal as an input and providing as an output an AC signal, the fundamental frequency of which follows the frequency of the pulse signal and the symmetry of which varies with the duty cycle of the pulse signal;

a resonant circuit into which the load is connected, the resonant circuit being driven by the AC signal, such that a change in the symmetry of the AC signal changes the level of current flowing through the load, the load being isolated from the converter means and the resonant circuit by means of an isolating transformer, the resonant circuit being designed to use impedance reflected through the isolating transformer.

2. A circuit according to claim 1, further comprising:

current sensing means for generating a current level signal proportional to the amount of current flowing through the load; and comparator means for comparing the current level signal with a dimming level signal indicative of the desired level of current flow through the load, the pulse width modulator means including means for adjusting the duty cycle of the pulse signal based on the result of the comparison of the current level signal with the dimming level signal.

3. A circuit according to claim 1, wherein the pulse width modulator means varies the duty cycle of the pulse signal between 0 and 50 percent, and wherein the AC signal is symmetric at a duty cycle of 50 percent and increasingly asymmetric as the duty cycle approaches 0 percent.

4. A circuit according to claim 3, wherein the ratio between the frequency of the pulse signal and the resonant frequency of the resonant circuit is greater than one.

5. A control circuit according to claim 1, wherein the converter means comprises:

a lower driver for receiving the modulated pulse signal as an input and for actuating a first switch on a DC supply to create the lower half of the AC signal output;

an upper driver for receiving the modulated pulse signal as an input and for actuating a second switch on the DC supply to create the upper half of the AC signal output;

delay means for introducing a delay between the actuation of the lower and upper drivers, such that the first and second switches do not conduct at the same time.

6. A circuit according to claim 1, wherein the resonant circuit includes an inductor and a capacitor connected in series with the load.

7. A circuit for controlling the flow of current through a load, comprising:

oscillator means for generating a pulse signal of constant frequency;

pulse width modulator means for varying the duty cycle of the pulse signal;

converter means for receiving the modulated pulse signal as an input and providing as an output an AC signal, the fundamental frequency of which follows the frequency of the pulse signal and the symmetry of which varies with the duty cycle of the pulse signal;

a resonant circuit into which the load is connected, the resonant circuit being driven by the AC signal, such that a change in the symmetry of the AC signal changes the level of current flowing through the load, the converter means comprising:

a lower driver for receiving the modulated pulse signal as an input and for actuating a first switch on a DC supply to create the lower half of the AC signal output;

an upper driver for receiving the modulated pulse signal as an input and for actuating a second switch on a DC supply to create the upper half of the AC signal output;

delay means for introducing a delay between the actuation of the lower and upper drivers, such that the first and second switches do not conduct at the same time, the delay means comprising an upper transistor network and a lower transistor network, the upper transistor network comprising:

a first transistor, the collector of which is connected to a voltage source, the emitter of which is connected to ground, and the base of which is held at the first transistor's $V_{BE}$ by a first capacitor charged by the voltage source; and a second transistor, the collector of which is connected between the voltage source and the first capacitor, the emitter of which is connected to ground, and the base of which receives the pulse signal as an input, such that when a pulse commences, the second transistor turns on, causing the first capacitor to discharge through the second transistor, thereby causing the first transistor to turn off, and such that when a pulse concludes, the second transistor turns off, causing the first capacitor to charge, thereby causing the first transistor to turn on after the first capacitor is charged;

the lower transistor network comprising:

a third transistor, the collector of which is connected to a voltage source, the emitter of which is connected to ground, and the base of which is connected to a voltage source;

a fourth transistor, the collector of which is connected between the voltage source and the base of the third transistor, the emitter of which is connected to ground, and the base of which is held at the fourth transistor's $V_{BE}$ by a second capacitor charged by the voltage source;

a fifth transistor, the collector of which is connected between the voltage source and the second capacitor, the emitter of which is connected to ground, and the base of which is connected to the voltage source; and a sixth transistor, the collector of which is connected to the voltage source, the emitter of which is connected to ground, and the base of which receives the pulse signal as an input, such that when a pulse commences, the sixth transistor turns on, causing the fifth transistor to turn off, causing the second capacitor to charge, causing the fourth transistor to turn on after the capacitor is charged, causing the third transistor to turn off, and such that when a pulse concludes, the sixth transistor turns off, causing the fifth transistor to turn on, causing the second capacitor to discharge, causing the fourth transistor to turn off, causing the third transistor turn on.

8. A circuit for controlling the flow of current through a load, comprising:

self-oscillating inverter means connected across a DC power supply for providing as an output an AC signal, the self-oscillating inverter means comprising first and second switches actuated, respectively, by first and second control inputs, and further comprising first and second feedback paths between the inverter output and, respectively, the first and second control inputs;

timer means connected into the second feedback path, between the inverter output and the second switch, the timer means adjusting the "on" time of the second switch in response to a "length" input, while the "on" time of the first switch remains substantially constant;

isolation interface means for receiving as an input a dimming signal and for providing as an output a signal that is used to generate the "length" input of the timer means; and resonant circuit means into which the load is connected, the resonant circuit receiving as an input the AC signal output of the inverter means and being tuned such that a change in the "on" time of the second switch results in a corresponding change in the current flowing through the load.

9. A circuit according to claim 8, further including:

a third switch coupled between the control input of the second switch and ground so as to turn off the second switch when a signal is applied to the control input of the third switch, the timer means further including:

means for generating a switch-actuating signal to actuate the third switch, and reset input means connected to the inverter output for resetting the timer means when the voltage across the second switch drops towards zero, the timer means "length" input determining the interval between the time at which the timer means is rest and the time at which the timer means generates the switch-actuating signal.

* * * * *